US009972436B2

(12) United States Patent
Hamada et al.

(10) Patent No.: US 9,972,436 B2
(45) Date of Patent: May 15, 2018

(54) MANUFACTURE METHOD OF COIL COMPONENT, AND COIL COMPONENT

(71) Applicant: Murata Manufacturing Co., Ltd., Kyoto (JP)

(72) Inventors: Akinori Hamada, Nagaokakyo-shi (JP); Kenji Nishiyama, Nagaokakyo-shi (JP); Shinji Yasuda, Nagaokakyo-shi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 25 days.

(21) Appl. No.: 15/180,743

(22) Filed: Jun. 13, 2016

(65) Prior Publication Data

US 2016/0379750 A1 Dec. 29, 2016

(30) Foreign Application Priority Data

Jun. 24, 2015 (JP) ..... 2015-126933

(51) Int. Cl.

| | |
|---|---|
| ***H01F 7/06*** | (2006.01) |
| ***H01F 41/04*** | (2006.01) |
| ***H01F 17/00*** | (2006.01) |
| ***H01F 17/04*** | (2006.01) |

(52) U.S. Cl.

CPC ..... *H01F 41/04* (2013.01); *H01F 7/06* (2013.01); *H01F 17/0013* (2013.01); *H01F 17/04* (2013.01); *H01F 41/046* (2013.01); *H01F 2017/0073* (2013.01)

(58) Field of Classification Search

CPC ..... H01F 5/00; H01F 27/00–27/36
USPC ..... 336/65, 83, 200, 232
See application file for complete search history.

(56) References Cited

U.S. PATENT DOCUMENTS 7,360,301 B2 * 4/2008 Sasaki ..... G11B 5/1877 205/119
2013/0200972 A1 * 8/2013 Wada ..... H01F 27/02 336/90

FOREIGN PATENT DOCUMENTS

| | | |
|---|---|---|
| JP | 2005-243807 A | 9/2005 |
| JP | 2007-227729 A | 9/2007 |
| JP | 2012-248630 A | 12/2012 |

OTHER PUBLICATIONS

An Office Action; "Notice of Reasons for Rejection," issued by the Japanese Patent Office dated Jan. 9, 2018, which corresponds to Japanese Patent Application No. 2015-126933 and is related to U.S. Appl. No. 15/180,743.

* cited by examiner

*Primary Examiner* — Tuyen Nguyen
(74) *Attorney, Agent, or Firm* — Studebaker & Brackett PC

(57) ABSTRACT

The manufacture method of a coil component includes the steps of bonding a dummy metal layer onto one face of a mounting base, stacking a base insulating resin on the dummy metal layer, stacking a first spiral wiring and a first insulating resin in this order on the base insulating resin to cover the first spiral wiring with the first insulating resin and stacking a second spiral wiring and a second insulating resin in this order on the first insulating resin to cover the second spiral wiring with the second insulating resin to thereby form a coil substrate, detaching the mounting base from the dummy metal layer in a bonding face between the one face of the mounting base and the dummy metal layer, removing the dummy metal layer from the coil substrate, and covering the coil substrate with a magnetic resin.

3 Claims, 19 Drawing Sheets

MANUFACTURE METHOD OF COIL COMPONENT, AND COIL COMPONENT

CROSS REFERENCE TO RELATED APPLICATIONS

This application claims benefit of priority to Japanese Patent Application 2015-126933 filed Jun. 24, 2015, the entire content of which is incorporated herein by reference.

TECHNICAL FIELD

The present disclosure relates to a manufacture method of a coil component, and a coil component.

BACKGROUND

A coil component is traditionally present that is described in JP 2012-248630. This coil component includes a substrate, spiral wirings disposed on both sides of the substrate, an insulating resin covering the substrate and the spiral wirings, and a magnetic resin covering the insulating resin.

SUMMARY

Problem to be Solved by the Disclosure

The inventor found that a problem as below arose when the traditional coil component was actually manufactured and used. Because the insulating resin covered the substrate, a thermal stress was generated by a difference in the linear expansion coefficient between the substrate and the insulating resin caused by a thermal impulse or a load during reflowing. The thermal stress caused layer detachment between the substrate and the insulating resin.

The object of the present disclosure is to provide a manufacture method of a coil component whose layer detachment caused by the thermal stress is prevented, and a coil component.

Solutions to the Problems

To solve the problem, the manufacture method of the coil component of the present disclosure includes the steps of bonding a dummy metal layer onto a mounting base, stacking a base insulating resin on the dummy metal layer, stacking a first spiral wiring and a first insulating resin in this order on the base insulating resin to cover the first spiral wiring with the first insulating resin and stacking a second spiral wiring and a second insulating resin in this order on the first insulating resin to cover the second spiral wiring with the second insulating resin, to thereby form a coil substrate, detaching the mounting base from the dummy metal layer at a bonding face between the mounting base and the dummy metal layer, removing the dummy metal layer from the coil substrate, and covering the coil substrate with a magnetic resin.

According to the manufacture method of the coil component of the present disclosure, the insulating resin of the coil substrate is not in contact with the mounting base because the mounting base is detached from the coil substrate and the coil substrate is covered with the magnetic resin. Any layer detachment can therefore be prevented that is caused by the thermal stress generated by a difference in the linear expansion coefficient between the mounting base and the insulating resin due to a thermal impulse or a load during reflowing.

According to one embodiment of the manufacture method of the coil component, the mounting base includes an insulating substrate and a base metal layer that is disposed on the insulating substrate and that is bonded to the dummy metal layer.

According to the embodiment, the dummy metal layer is bonded to a smooth face of the base metal layer because the dummy metal layer is bonded to the base metal layer of the mounting base. The bonding force between the dummy metal layer and the base metal layer can therefore be weakened and the mounting base can therefore be easily detached from the dummy metal layer.

According to one embodiment of the manufacture method of a coil component, the step of forming the coil substrate includes the steps of disposing an opening in the base insulating resin to expose the dummy metal layer, disposing the first spiral wiring on the base insulating resin and disposing a first sacrificial electric conductor that corresponds to an inner flux path, on the dummy metal layer in the opening of the base insulating resin, thickening the first spiral wiring using plating by directly or indirectly energizing the first spiral wiring and thickening the first sacrificial electric conductor connected to the dummy metal layer using plating by energizing the dummy metal layer, covering the first spiral wiring and the first sacrificial electric conductor with the first insulating resin, disposing an opening in the first insulating resin to thereby expose the first sacrificial electric conductor, disposing the second spiral wiring on the first insulating resin and disposing a second sacrificial electric conductor that corresponds to an inner flux path, on the first sacrificial electric conductor in the opening of the first insulating resin, thickening the second spiral wiring using plating by directly or indirectly energizing the second spiral wiring and thickening the second sacrificial electric conductor using plating through the first sacrificial electric conductor by energizing the dummy metal layer, covering the second spiral wiring and the second sacrificial electric conductor with the second insulating resin, disposing an opening in the second insulating resin to expose the second sacrificial electric conductor, and removing the first sacrificial electric conductor and the second sacrificial electric conductor to form a hole that corresponds to an inner flux path, wherein at the step of covering the coil substrate with the magnetic resin, the hole is filled with the magnetic resin to configure the inner flux path using the magnetic resin.

According to the embodiment, the first spiral wiring and the first sacrificial electric conductor are disposed at one step. The first spiral wiring and the first sacrificial electric conductor are both electric conductors and can therefore be formed at one step. The same is applied to the case where the second spiral wiring and the second sacrificial electric conductor are disposed. The total is thereby small of the tolerance of the position of the hole (the sacrificial electric conductor) for the inner flux path relative to the insulating resin and the tolerance of the position of the spiral wiring relative to the insulating resin. As a result, the cross-sectional area of the inner flux path can be set to be large and a higher inductance value can be acquired.

The first spiral wiring is thickened using plating by directly or indirectly energizing the first spiral wiring and the first sacrificial electric conductor connected to the dummy metal layer is thickened using plating by energizing the dummy metal layer. Any difference can thereby be avoided between the thickness of the first spiral wiring and the thickness of the first sacrificial electric conductor. The depth of the opening thereby becomes small and the formation of the opening becomes easy when the opening is disposed in the first insulating resin that covers the first spiral wiring and the first sacrificial electric conductor to expose the first sacrificial electric conductor. The depth of the opening becomes constant when the second spiral wiring and the second sacrificial electric conductor are disposed and the opening is disposed in the second insulating resin. Even when multiple layers are formed, the depth of the opening is constant and the formation of the opening is easy. The shapes of the sacrificial electric conductors disposed in the opening can be set to be same.

A coil component of the present disclosure includes a base insulating resin, a first spiral wiring stacked on the base insulating resin, a first insulating resin that is stacked on the first spiral wiring and that covers the first spiral wiring, a second spiral wiring that is stacked on the first insulating resin and that is connected to the first spiral wiring through a via wiring extending in the layer stacking direction, a second insulating resin that is stacked on the second spiral wiring and that covers the second spiral wiring, and a magnetic resin that covers the base insulating resin, the first insulating resin, and the second insulating resin.

According to the coil component of the present disclosure, no substrate is originally present on which the first and the second spiral wirings are stacked and the insulating resin is not in contact with any substrate because the first spiral wiring and the second spiral wiring are each stacked on the insulating resin. Any layer detachment can therefore be prevented that is caused by the thermal stress generated by a difference in the linear expansion coefficient between the substrate and the insulating resin due to a thermal impulse or a load during reflowing.

According to one embodiment of the coil component, the base insulating resin, the first insulating resin, and the second insulating resin include the same material.

According to the embodiment, because the base insulating resin, the first insulating resin, and the second insulating resin include the same material, any difference in the linear expansion coefficient among the insulating resins can be avoided and any layer detachment of the insulating resins due to a thermal impulse or a load during reflowing can be prevented.

According to one embodiment of the coil component, the cross-sectional shapes in the layer stacking direction of the first spiral wiring and the second spiral wiring are each a convex shape that protrudes in the same direction of the layer stacking direction and that has a curved side face.

According to the embodiment, the cross-sectional shapes in the layer stacking direction of the first spiral wiring and the second spiral wiring are each a convex shape that protrudes in the same direction of the layer stacking direction and that has a curved side face. The first and the second spiral wirings thereby become difficult to be bent against a force in the layer stacking direction and any detachment between the first and the second spiral wirings, and the insulating resins can be suppressed.

Effect of the Disclosure

According to the manufacture method of a coil component of the present disclosure, any layer detachment caused by the thermal stress can be prevented because the mounting base is detached from the coil substrate.

According to the coil component of the present disclosure, any layer detachment caused by the thermal stress can be prevented because the first and the second spiral wirings are each stacked on the insulating resin.

DETAILED DESCRIPTION

The present disclosure will be described in detail with reference to depicted embodiments.

First Embodiment

Figure 1:
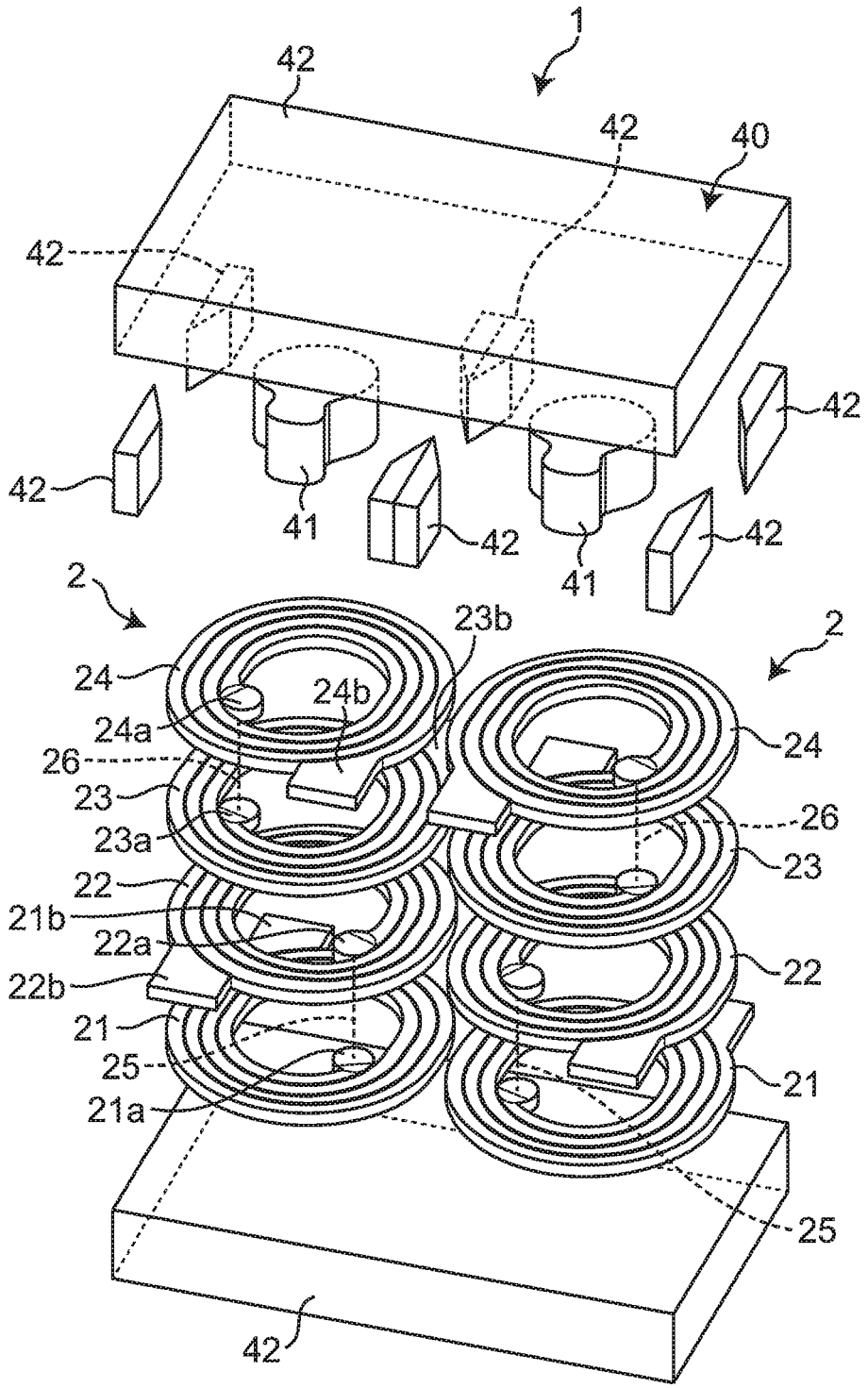
FIG. 1 is an exploded perspective diagram of an electronic part that includes a first embodiment of a coil component of the present disclosure.
Figure 2:
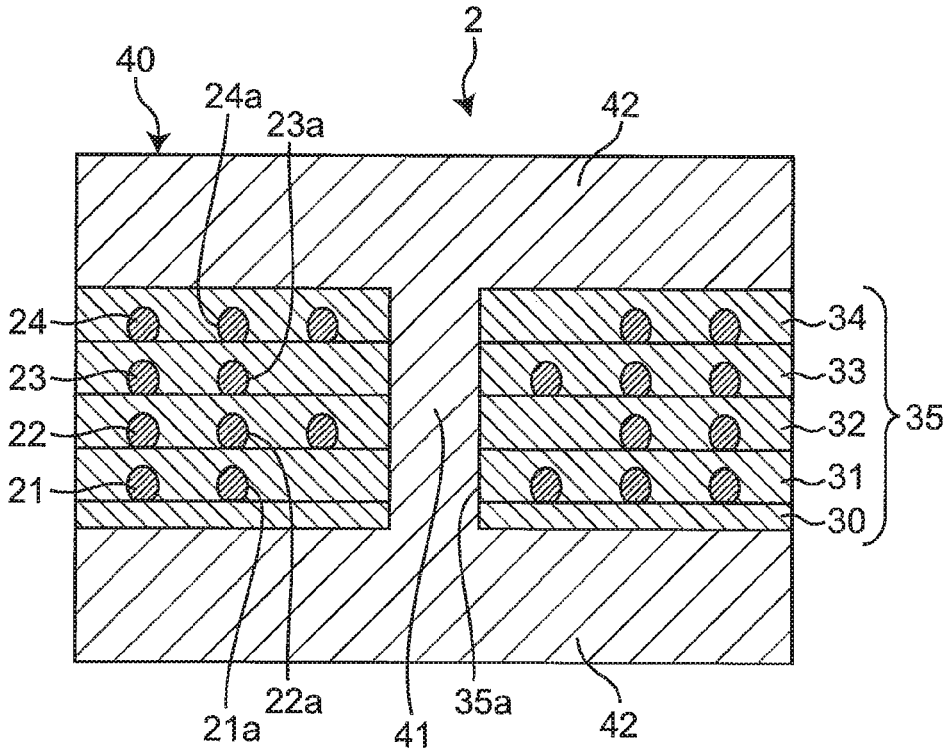
FIG. 2 is a cross-sectional diagram of the coil component.

FIG. 1 is an exploded perspective diagram of an electronic part that includes a first embodiment of a coil component of the present disclosure. FIG. 2 is a cross-sectional diagram of the coil component. As depicted in FIG. 1, the electronic part 1 is mounted on an electronic apparatus such as, for example, a personal computer, a DVD player, a digital camera, a TV, a mobile phone, or an on-vehicle electronic apparatus. The electronic part 1 includes two coil components 2 disposed in parallel to each other.

As depicted in FIG. 1 and FIG. 2, the coil components 2 each include spiral wirings 21 to 24 in four layers, an insulating resin body 35 that covers all of the spiral wirings 21 to 24 in the four layers, and a magnetic resin 40 that covers the insulating resin body 35. To "cover an object" as used herein refers to covering at least a portion of the object. In FIG. 1, the insulating resin body 35 is not depicted.

A first to the fourth spiral wirings 21 to 24 are sequentially disposed from the lowest layer to the top layer. The first to the fourth spiral wirings 21 to 24 are each formed in a plane and in a spiral. The first to the fourth spiral wirings 21 to 24 each include a low-resistance metal such as, for example, Cu, Ag, or Au. Preferably, a low-resistance spiral wiring having a narrow pitch can be formed by using Cu plating formed by employing a semi-additive process.

The insulating resin body 35 includes a base insulating resin 30 and a first to a fourth insulating resins 31 to 34. The base insulating resin 30 and the first to the fourth insulating resins 31 to 34 are sequentially disposed from the lowest layer to the top layer. The material of the insulating resins 30 to 34 is, for example, an insulating material including a single material of organic insulating materials including an epoxy-based resin, a bismaleimide, a liquid crystal polymer, and a polyimide, or a combination of the single material and an inorganic filler material such as a silica filler or an organic filler including a rubber-based material. Preferably, all the insulating resins 30 to 34 include the same material. In the embodiment, all the insulating resins 30 to 34 include an epoxy resin that includes a silica filler.

The first spiral wiring 21 is stacked on the base insulating resin 30. The first insulating resin 31 is stacked on the first spiral wiring 21 to cover the first spiral wiring 21. The second spiral wiring 22 is stacked on the first insulating resin 31. The second insulating resin 32 is stacked on the second spiral wiring 22 to cover the second spiral wiring 22.

The third spiral wiring 23 is stacked on the second insulating resin 32. The third insulating resin 33 is stacked on the third spiral wiring 23 to cover the third spiral wiring 23. The fourth spiral wiring 24 is stacked on the third insulating resin 33. The fourth insulating resin 34 is stacked on the fourth spiral wiring 24 to cover the fourth spiral wiring 24.

The second spiral wiring 22 is connected to the first spiral wiring 21 through a via wiring 25 that extends in the layer stacking direction. The via wiring 25 is disposed in the first insulating resin 31. An inner circumferential end 21*a* of the first spiral wiring 21 and an inner circumferential end 22*a* of the second spiral wiring 22 are connected to each other through the via wiring 25. An outer circumferential end 21*b* of the first spiral wiring 21 is connected to an external electrode not depicted. An outer circumferential end 22*b* of the second spiral wiring 22 is connected to an external electrode not depicted.

The fourth spiral wiring 24 is connected to the third spiral wiring 23 through a via wiring 26 extending in the layer stacking direction. The via wiring 26 is disposed in the third insulating resin 33. An inner circumferential end 23*a* of the third spiral wiring 23 and an inner circumferential end 24*a* of the fourth spiral wiring 24 are connected to each other through the via wiring 26. An outer circumferential end 23*b* of the third spiral wiring 23 is connected to an external electrode not depicted. An outer circumferential end 24*b* of the fourth spiral wiring 24 is connected to an external electrode not depicted.

The first to the fourth spiral wirings 21 to 24 are arranged centering the same one axis. The first spiral wiring 21 and the second spiral wiring 22 are wound in the same direction, seen from the axis direction (the layer stacking direction). The third spiral wiring 23 and the fourth spiral wiring 24 are wound in the same direction, seen from the axis direction. The first and the second spiral wirings 21 and 22, and the third and the fourth spiral wirings 23 and 24 are each wound in the direction opposite to that of each other, seen from the axis direction.

The cross-sectional shapes in the layer stacking direction of the first to the fourth spiral wirings 21 to 24 are each a convex shape that protrudes in the same direction of the layer stacking direction. The convex shapes of the first to the fourth spiral wirings 21 to 24 respectively include curved side faces 21*a* to 24*a*.

Inner faces and outer faces of the first to the fourth spiral wirings 21 to 24 are covered with the insulating resin body 35. The insulating resin body 35 includes holes 35*a* that each center the same one axis of the first to the fourth spiral wirings 21 to 24.

The magnetic resin 40 covers the insulating resin body 35. The magnetic resin 40 includes inner portions 41 each disposed in a hole 35*a* of the insulating resin body 35, and an outer portion 42 disposed outside the insulating resin body 35 (on an outer circumferential face, and the upper and the lower end faces). The inner portions 41 each constitute the inner flux path of the coil component 2 and the outer portion 42 constitutes an outer flux path of the coil component 2.

The material of the magnetic resin 40 is, for example, a resin material that includes magnetic substance powder. The magnetic substance powder is a metal magnetic material such as, for example, Fe, Si, Cr, or the like. The resin material is a resin material such as, for example, epoxy. Preferably, the magnetic substance powder is included by 90 wt % or more to improve the properties (the L value and the superimposition property) of the coil component 2. More preferably, two or three types of magnetic substance powder having particle size distributions different from each other are mixed in to improve the filling property of the magnetic resin 40.

A manufacture method of the coil component 2 will be described.

Figure 3A:
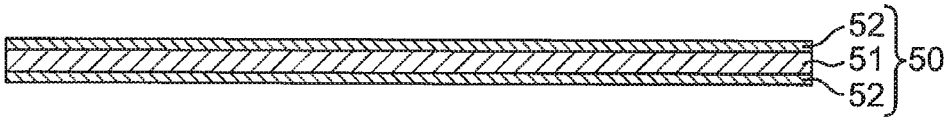
FIG. 3A is a diagram for explaining a first embodiment of a manufacture method of a coil component of the present disclosure.

As depicted in FIG. 3A, a mounting base 50 is prepared. The mounting base 50 includes an insulating substrate 51 and base metal layers 52 disposed on both sides of the insulating substrate 51. In this embodiment, the insulating substrate 51 is a glass epoxy substrate and a base metal layer 52 is a Cu foil sheet.

Figure 3B:
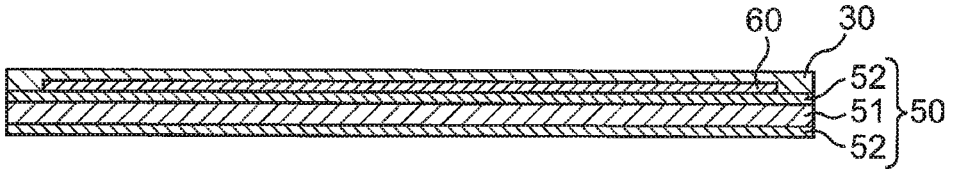
FIG. 3B is a diagram for explaining the first embodiment of the manufacture method of a coil component of the present disclosure.

As depicted in FIG. 3B, a dummy metal layer 60 is bonded to one face of the mounting base 50. In this embodiment, the dummy metal layer 60 is a Cu foil sheet. Because the dummy metal layer 60 is bonded to the base metal layer 52 of the mounting base 50, the dummy metal layer 60 is bonded to a smooth face of the base metal layer 52. The bonding force between the dummy metal layer 60 and the base metal layer 52 can therefore be weakened, and the mounting base 50 can be easily detached from the dummy metal layer 60 in the post-process. Preferably, the adhesive to bond the mounting base 50 and the dummy metal layer 60 to each other is a low bonding force adhesive. Preferably, the bonding faces of the mounting base 50 and the dummy metal layer 60 are glossy surfaces to weaken the bonding force between the mounting base 50 and the dummy metal layer 60.

The base insulating resin 30 is stacked on the dummy metal layer 60 temporarily clamped on the mounting base 50. In this case, the base insulating resin 30 is stacked using a vacuum laminator and is thermally hardened.

Figure 3C:
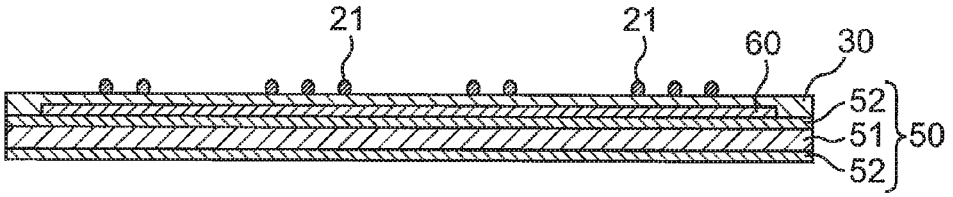
FIG. 3C is a diagram for explaining the first embodiment of the manufacture method of a coil component of the present disclosure.

As depicted in FIG. 3C, the first spiral wiring 21 is stacked on the base insulating resin 30. In this stacking, the two first spiral wirings 21 and 21 are disposed in parallel to each other. Manufacture of the first spiral wiring 21 includes a step of forming an underlying wiring using SAP (Semi Additive Process) and a step of applying a plating process to the underlying wiring, and the first spiral wiring 21 having the convex arc cross section is thereby formed.

Figure 3D:
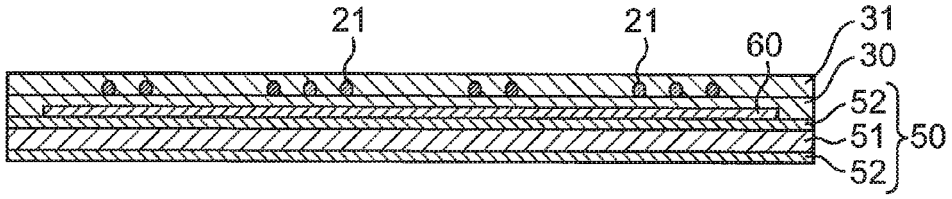
FIG. 3D is a diagram for explaining the first embodiment of the manufacture method of a coil component of the present disclosure.

As depicted in FIG. 3D, the first insulating resin 31 is stacked on the first spiral wiring 21 to cover the first spiral wiring 21 with the first insulating resin 31. In this case, the first insulating resin 31 is stacked using a vacuum laminator and is thermally hardened. A via hole to be filled with the via wiring 25 is formed in the first insulating resin 31 using laser processing.

Figure 3E:
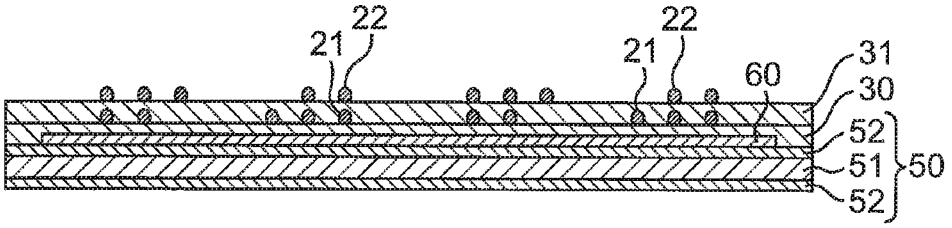
FIG. 3E is a diagram for explaining the first embodiment of the manufacture method of a coil component of the present disclosure.

As depicted in FIG. 3E, the second spiral wiring 22 is stacked on the first insulating resin 31. In this case, the second spiral wiring 22 is disposed using the same process as that for the first spiral wiring 21.

Figure 3F:
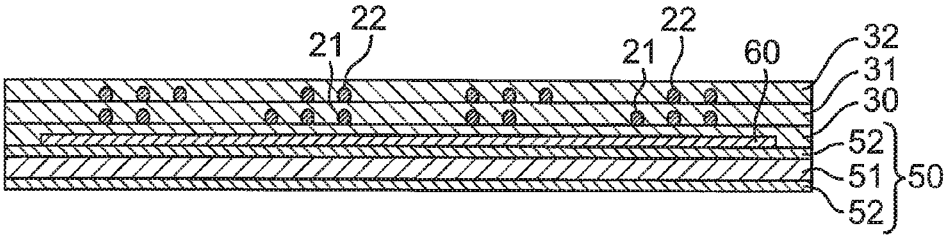
FIG. 3F is a diagram for explaining the first embodiment of the manufacture method of a coil component of the present disclosure.

As depicted in FIG. 3F, the second insulating resin 32 is stacked on the second spiral wiring 22 to cover the second spiral wiring 22 with the second insulating resin 32. In this case, the second insulating resin 32 is disposed using the same process as that for the first insulating resin 31.

Figure 3G:
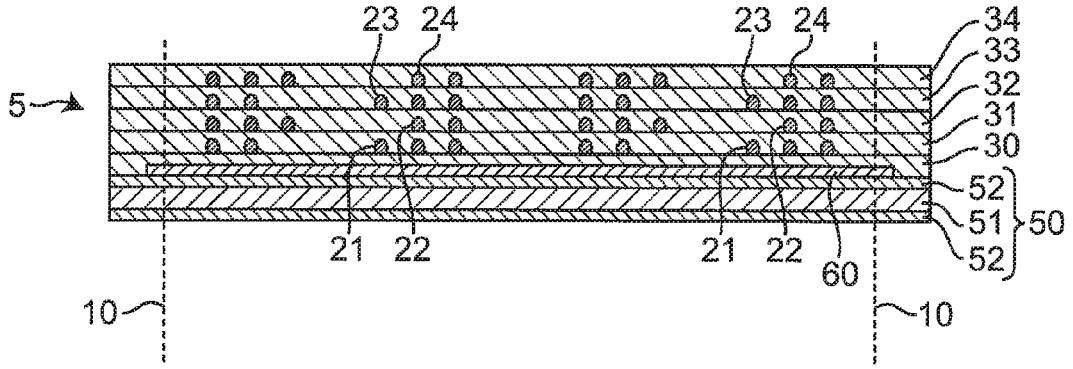
FIG. 3G is a diagram for explaining the first embodiment of the manufacture method of a coil component of the present disclosure.

As depicted in FIG. 3G, by repeating the same method as the method of FIG. 3C to FIG. 3F, the third spiral wiring 23 and the third insulating resin 33 are sequentially stacked on the second insulating resin 32 to cover the third spiral wiring 23 with the third insulating resin 33, and the fourth spiral wiring 24 and the fourth insulating resin 34 are sequentially stacked on the third insulating resin 33 to cover the fourth spiral wiring 24 with the fourth insulating resin 34. A via hole to be filled with a via wiring 26 is formed in the third insulating resin 33 using laser processing. In this manner, the coil substrate 5 is formed using the base insulating resin 30, the first to the fourth insulating resins 31 to 34, and the first to the fourth spiral wirings 21 to 24.

Figure 3H:
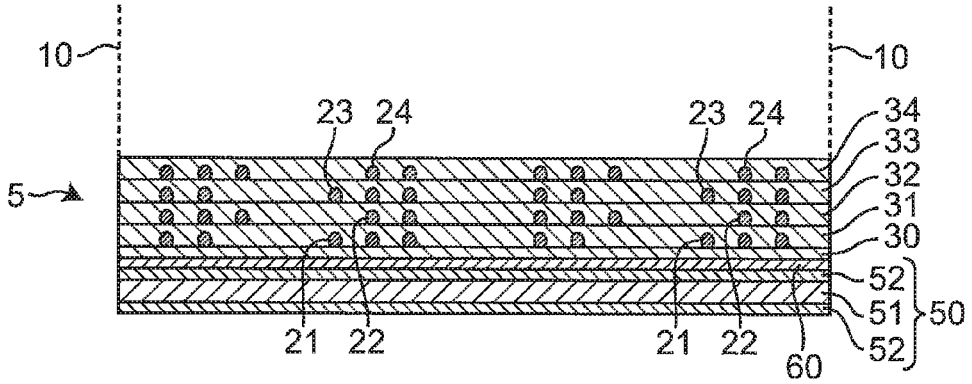
FIG. 3H is a diagram for explaining the first embodiment of the manufacture method of a coil component of the present disclosure.

As depicted in FIG. 3H, the ends of the coil substrate 5 together with the ends of the mounting base 50 are cut out along cutting lines 10. The cutting lines 10 are positioned to be spaced inwardly from the end faces of the dummy metal layer 60.

Figure 3I:
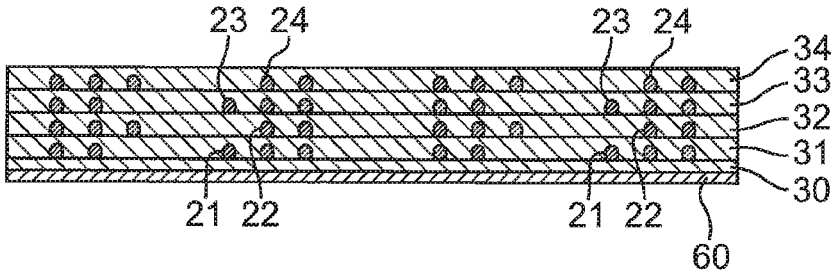
FIG. 3I is a diagram for explaining the first embodiment of the manufacture method of a coil component of the present disclosure.

As depicted in FIG. 3I, the mounting base 50 is detached from the dummy metal layer 60 in the bonding face between the one face of the mounting base 50 (the base metal layer 52) and the dummy metal layer 60.

Figure 3J:
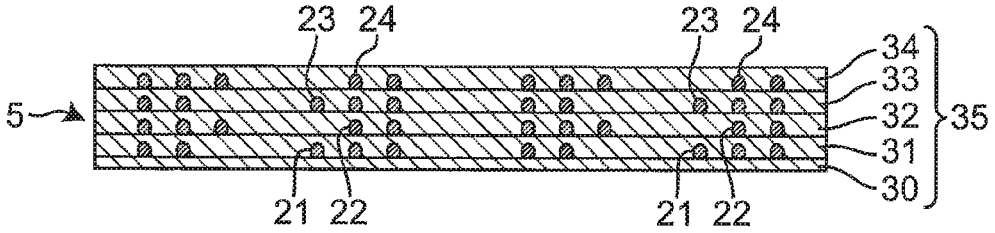
FIG. 3J is a diagram for explaining the first embodiment of the manufacture method of a coil component of the present disclosure.

As depicted in FIG. 3J, the dummy metal layer 60 is removed from the coil substrate 5. For this removal, the dummy metal layer 60 is removed by etching. The first to the fourth spiral wirings 21 to 24 are covered with the insulating resin body 35 constituted by the base insulating resin 30, and the first to the fourth insulating resins 31 to 34.

Figure 3K:
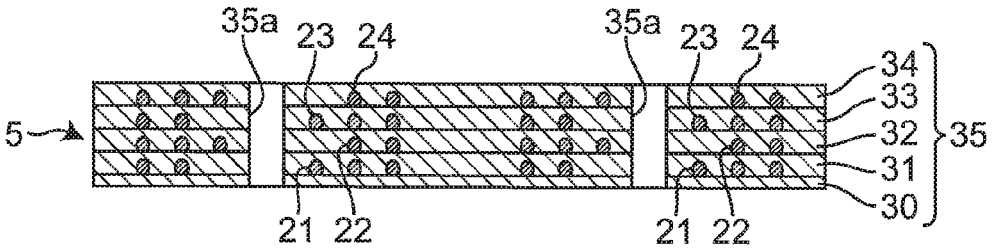
FIG. 3K is a diagram for explaining the first embodiment of the manufacture method of a coil component of the present disclosure.

As depicted in FIG. 3K, the holes 35*a* each corresponding to the inner flux path are disposed in the insulating resin body 35. The holes 35*a* are positioned inside the first to the fourth spiral wirings 21 to 24. The holes 35*a* are formed using laser processing or the like, each penetrating the insulating resin body 35 in the layer stacking direction.

Figure 3L:
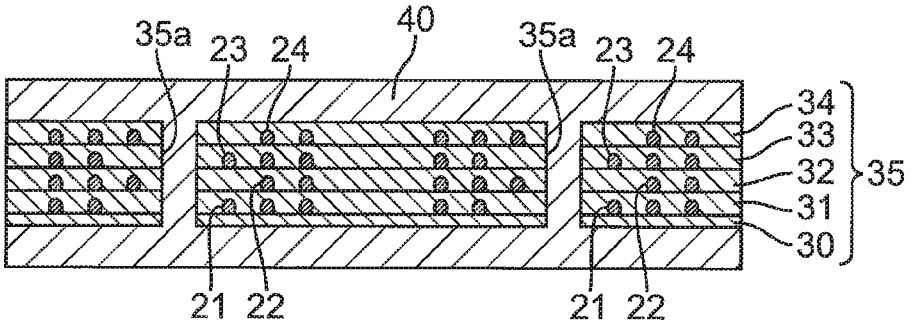
FIG. 3L is a diagram for explaining the first embodiment of the manufacture method of a coil component of the present disclosure.

As depicted in FIG. 3L, the coil substrate 5 is covered with the magnetic resin 40. For this covering, the plural magnetic resins 40 each formed in a sheet are arranged on both sides in the layer stacking direction of the coil substrate 5, are applied with thermal compression bonding using a vacuum laminator or a vacuum pressing machine, and are thereafter applied with a hardening process. The magnetic resins 40 are caused to fill up the holes 35*a* of the insulating resin body 35 to constitute the inner flux paths and are disposed outside the insulating resin body 35 to constitute the outer flux path.

Figure 3M:
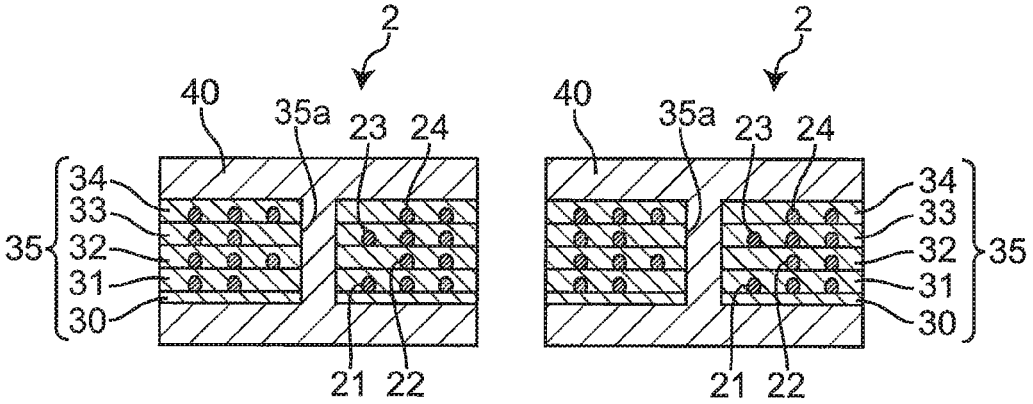
FIG. 3M is a diagram for explaining the first embodiment of the manufacture method of a coil component of the present disclosure.

As depicted in FIG. 3M, chips are cut out using a dicer or the like to be separated into individual pieces and external terminals (not depicted) are thereafter connected to ends of the spiral wirings 21 to 24 exposed in the cutting face to form the coil component 2.

According to the manufacture method of the coil component 2, because the mounting base 50 is detached from the coil substrate 5 and the coil substrate 5 is covered with the magnetic resin 40, the insulating resins 30 to 34 of the coil substrate 5 are not in contact with the mounting base 50. Any layer detachment can therefore be prevented that is caused by the thermal stress generated by a difference in the linear expansion coefficient between the mounting base 50 and the insulating resins 30 to 34 due to a thermal impulse or a load during reflowing.

Because the coil substrate 5 is formed by stacking the insulating resins 30 to 34 and the spiral wirings 21 to 24 on the mounting base 50, thickening the mounting base 50 can reduce any processing strain generated by shrinking of the insulating resins 30 to 34 and the difference in the linear expansion coefficient between the mounting base 50 and the insulating resins 30 to 34. Especially, when the coil substrate 5 is configured to include the multiple layers, higher precision can be realized by effectively reducing the processing strain. Because the mounting base 50 is thereafter detached from the coil substrate 5, the thickness of the coil component 2 can be reduced. An increase of layers and the higher precision can therefore be concurrently established without increasing the thickness of the coil component 2.

Because the coil component 2 can be constituted by the insulating resins 30 to 34 and the spiral wirings 21 to 24, the density of the spiral wirings 21 to 24 can be increased. The L value can therefore be increased and Rdc can be reduced to facilitate enhancement of the performance.

According to the manufacture method of the coil component 2, because the dummy metal layer 60 is bonded to the base metal layer 52 of the mounting base 50, the dummy metal layer 60 is bonded to the smooth face of the base metal layer 52. The bonding force can therefore be weakened between the dummy metal layer 60 and the base metal layer 52, and the mounting base 50 can easily be detached from the dummy metal layer 60.

According to the coil component 2, because the spiral wirings 21 to 24 are respectively stacked on the insulating resins 30 to 34, any substrate on which the spiral wirings 21 to 24 are stacked is not originally present and the insulating resins 30 to 34 are not in contact with the substrate. Any layer detachment can therefore be prevented that is caused by the thermal stress generated by a difference in the linear expansion coefficient between the substrate and the insulating resins 30 to 34 due to a thermal impulse or a load during reflowing.

According to the coil component 2, because all the insulating resins 30 to 34 include the same material, any difference can be avoided in the linear expansion coefficient among the insulating resins 30 to 34 and any layer detachment of the insulating resins 30 to 34 can be prevented that is caused due to a thermal impulse or a load during reflowing.

According to the coil component 2, the cross-sectional shapes in the layer stacking direction of the spiral wirings 21 to 24 are the convex shapes that each protrudes in the same direction in the layer stacking direction and that respectively include the curved side faces 21*a* to 24*a*. The spiral wirings 21 to 24 thereby become difficult to be bent against a force in the layer stacking direction and any detachment can be suppressed between the spiral wirings 21 to 24 and the insulating resins 30 to 34.

Second Embodiment

Figure 4A:
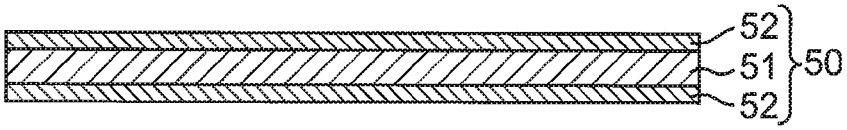
FIG. 4A is a diagram for explaining a second embodiment of the manufacture method of a coil component of the present disclosure.
Figure 4B:
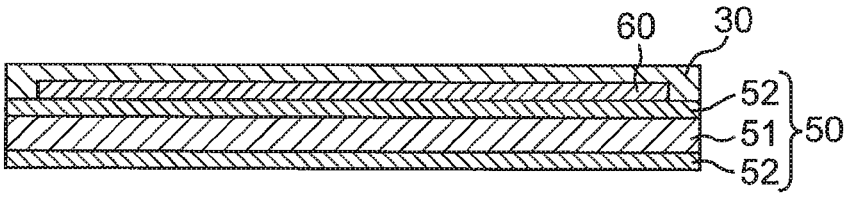
FIG. 4B is a diagram for explaining the second embodiment of the manufacture method of a coil component of the present disclosure.
Figure 4C:
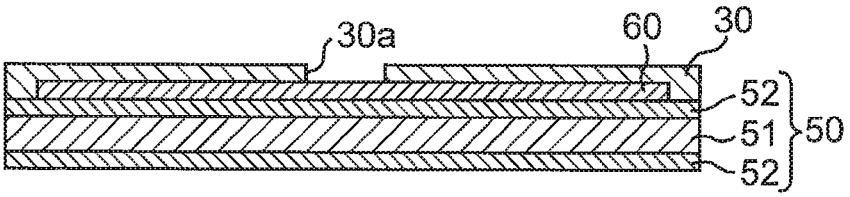
FIG. 4C is a diagram for explaining the second embodiment of the manufacture method of a coil component of the present disclosure.
Figure 4D:
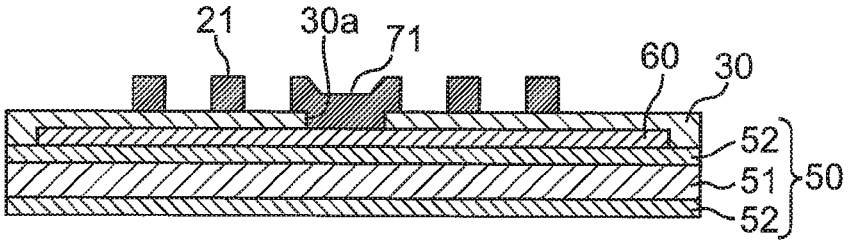
FIG. 4D is a diagram for explaining the second embodiment of the manufacture method of a coil component of the present disclosure.
Figure 4E:
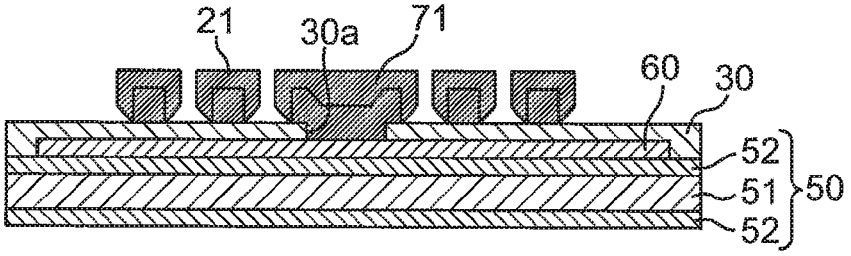
FIG. 4E is a diagram for explaining the second embodiment of the manufacture method of a coil component of the present disclosure.
Figure 4F:
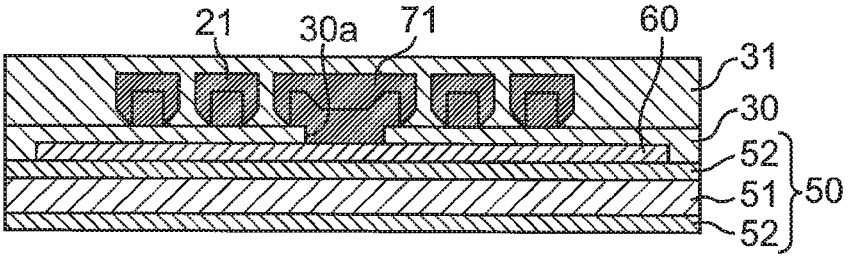
FIG. 4F is a diagram for explaining the second embodiment of the manufacture method of a coil component of the present disclosure.
Figure 4G:
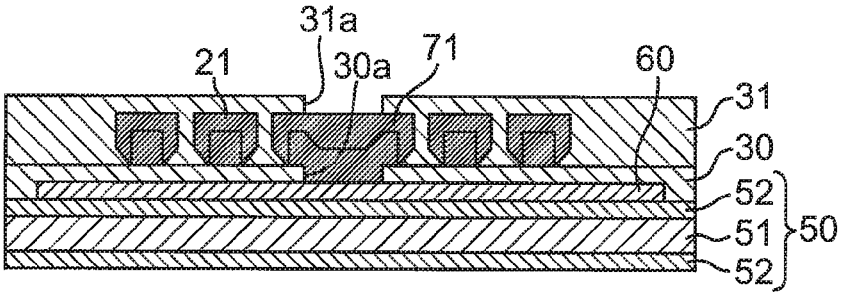
FIG. 4G is a diagram for explaining the second embodiment of the manufacture method of a coil component of the present disclosure.
Figure 4H:
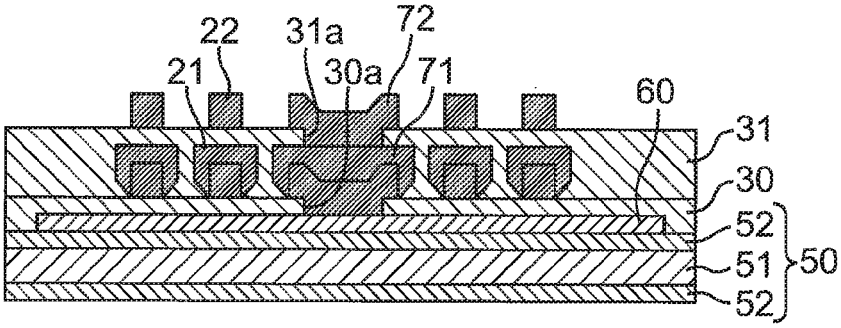
FIG. 4H is a diagram for explaining the second embodiment of the manufacture method of a coil component of the present disclosure.
Figure 4I:
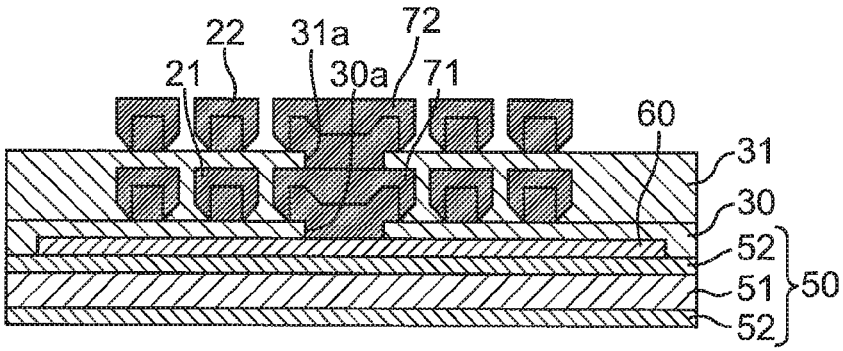
FIG. 4I is a diagram for explaining the second embodiment of the manufacture method of a coil component of the present disclosure.
Figure 4J:
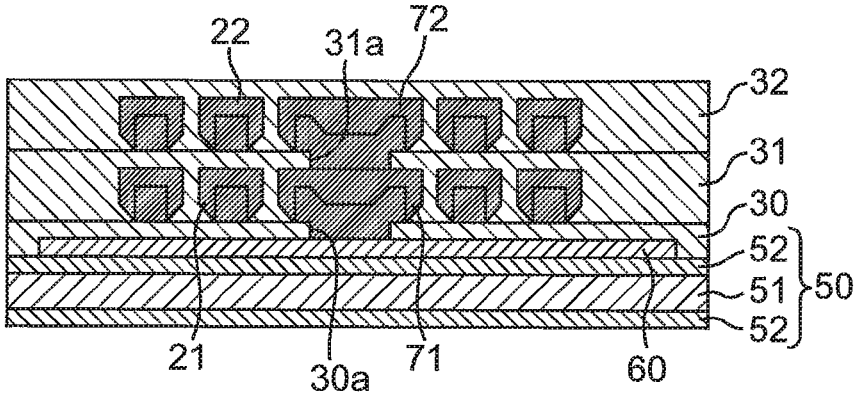
FIG. 4J is a diagram for explaining the second embodiment of the manufacture method of a coil component of the present disclosure.
Figure 4K:
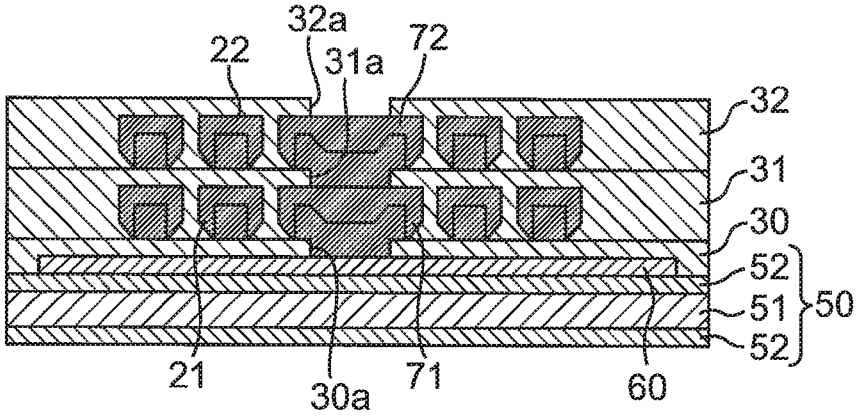
FIG. 4K is a diagram for explaining the second embodiment of the manufacture method of a coil component of the present disclosure.
Figure 4L:
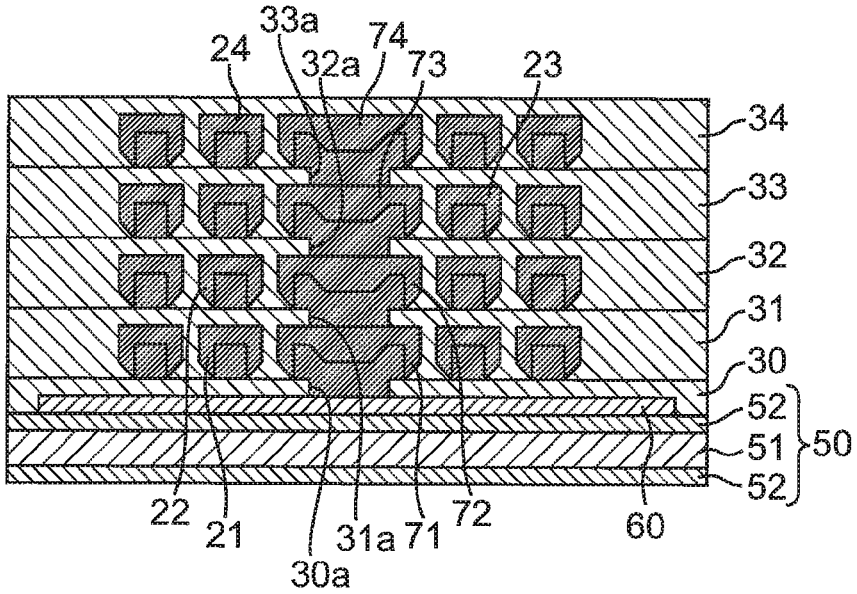
FIG. 4L is a diagram for explaining the second embodiment of the manufacture method of a coil component of the present disclosure.
Figure 4M:
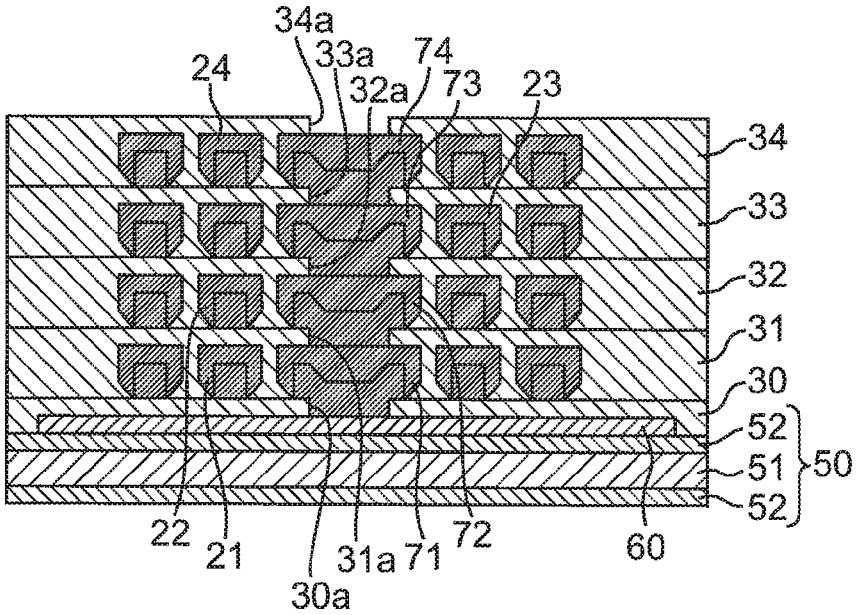
FIG. 4M is a diagram for explaining the second embodiment of the manufacture method of a coil component of the present disclosure.
Figure 4N:
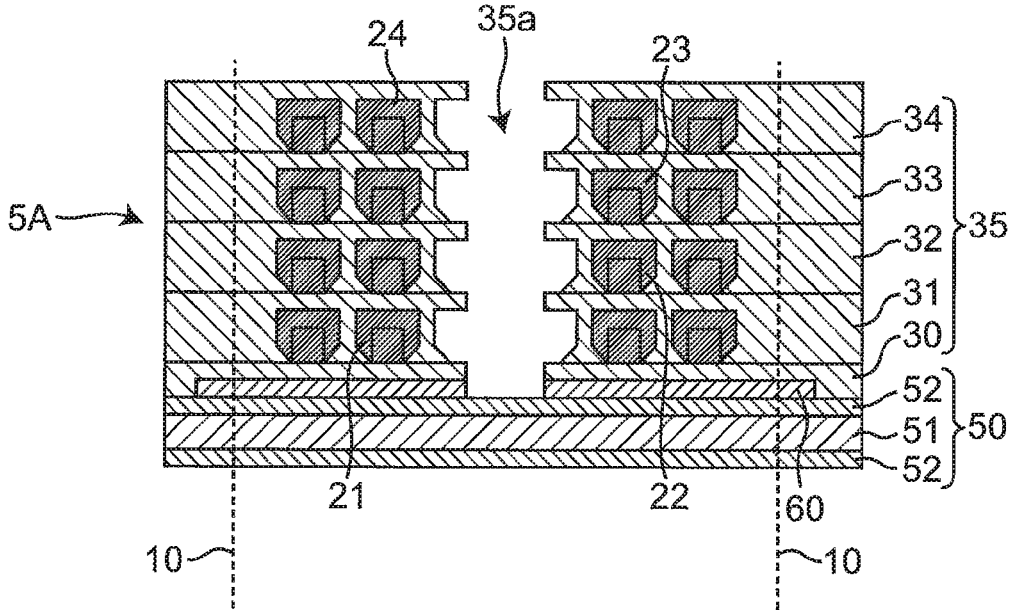
FIG. 4N is a diagram for explaining the second embodiment of the manufacture method of a coil component of the present disclosure.
Figure 4O:
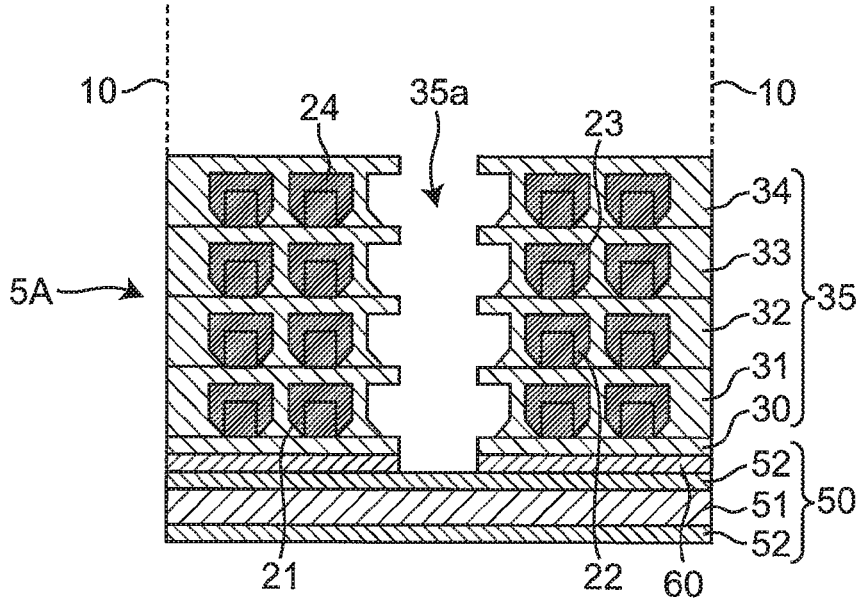
FIG. 4O is a diagram for explaining the second embodiment of the manufacture method of a coil component of the present disclosure.
Figure 4P:
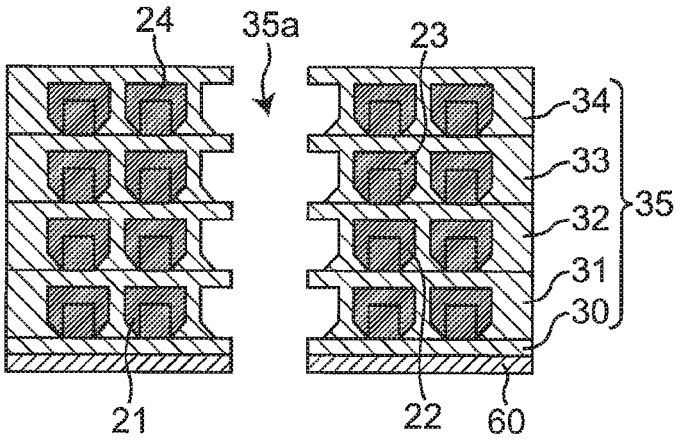
FIG. 4P is a diagram for explaining the second embodiment of the manufacture method of a coil component of the present disclosure.
Figure 4Q:
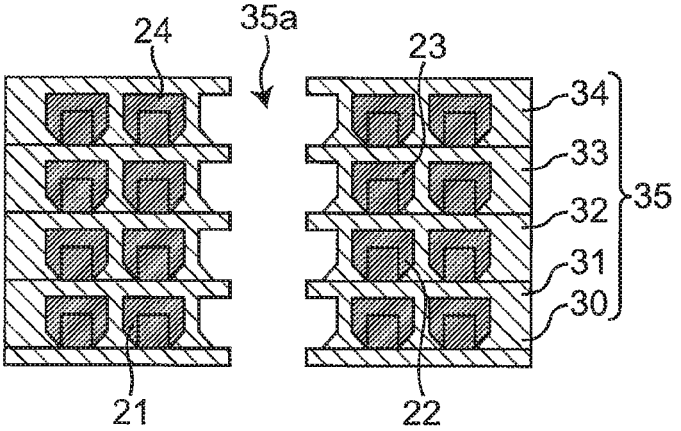
FIG. 4Q is a diagram for explaining the second embodiment of the manufacture method of a coil component of the present disclosure.
Figure 4R:
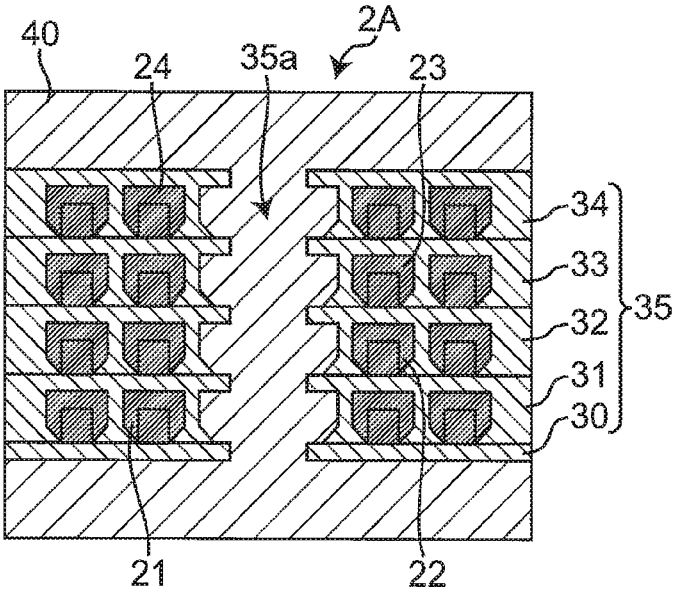
FIG. 4R is a diagram for explaining the second embodiment of the manufacture method of a coil component of the present disclosure.

FIG. 4A to FIG. 4R are diagrams for explaining a second embodiment of the manufacture method of the coil component of the present disclosure. The second embodiment differs from the first embodiment in the step of forming the coil substrate. In the second embodiment, same reference numerals as those in the first embodiment denote the same configurations as those in the first embodiment and will therefore not again be described.

As depicted in FIG. 4A, the mounting base 50 is prepared. The mounting base 50 includes the insulating substrate 51 and base metal layers 52 disposed on both sides of the insulating substrate 51. As depicted in FIG. 4B, the dummy metal layer 60 is bonded onto the one face of the mounting base 50 and the base insulating resin 30 is stacked on the dummy metal layer 60.

As depicted in FIG. 4C, an opening 30*a* is disposed in a portion of the base insulating resin 30 to expose the dummy metal layer 60. The opening 30*a* is formed using laser processing.

As depicted in FIG. 4D, the first spiral wiring 21 is disposed on the base insulating resin 30 and a first sacrificial electric conductor 71 corresponding to the inner flux path is disposed on the dummy metal layer 60 in the opening 30*a* of the base insulating resin 30. In this case, the spiral wiring 21 and the first sacrificial electric conductor 71 are concurrently formed using SAP (Semi Additive Process).

As depicted in FIG. 4E, the first spiral wiring 21 is thickened using plating by indirectly energizing the first spiral wiring 21 and the first sacrificial electric conductor 71 connected to the dummy metal layer 60 is thickened using plating by energizing the dummy metal layer 60. The low-resistance spiral wiring having a narrow pitch can thereby be formed. By connecting the first spiral wiring 21 to a wiring pattern not depicted, the first spiral wiring 21 is indirectly energized through the wiring pattern. The first spiral wiring 21 may directly be energized. The first spiral wiring 21 and the first sacrificial electric conductor 71 may concurrently be formed and this can reduce the processing time period.

As depicted in FIG. 4F, the first spiral wiring 21 and the first sacrificial electric conductor 71 are covered with the first insulating resin 31. For this covering, the first insulating resin 31 is stacked using a vacuum laminator and is thereafter thermally hardened.

As depicted in FIG. 4G, an opening 31*a* is disposed in a portion of the first insulating resin 31 to expose the first sacrificial electric conductor 71. The opening 31*a* is formed using laser processing.

As depicted in FIG. 4H, the second spiral wiring 22 is disposed on the first insulating resin 31 and a second sacrificial electric conductor 72 corresponding to the inner flux path is disposed on the first sacrificial electric conductor 71 in the opening 31*a* of the first insulating resin 31. The processes for the second and the later layers are each the same as the process for the first layer.

As depicted in FIG. 4I, the second spiral wiring 22 is thickened using plating by directly or indirectly energizing the second spiral wiring 22 and the second sacrificial electric conductor 72 is thickened using plating through the first sacrificial electric conductor 71 by energizing the dummy metal layer 60.

As depicted in FIG. 4J, the second spiral wiring 22 and the second sacrificial electric conductor 72 are covered with the second insulating resin 32.

As depicted in FIG. 4K, an opening 32*a* is disposed in a portion of the second insulating resin 31 to expose the second sacrificial electric conductor 72.

As depicted in FIG. 4L, the same process as that for the second layer is executed to dispose the third spiral wiring 23, the third sacrificial electric conductor 73, and the third insulating resin 33 for the third layer, and the fourth spiral wiring 24, a fourth sacrificial electric conductor 74, and the fourth insulating resin 34 for the fourth layer. The third sacrificial electric conductor 73 is thickened using plating through the first and the second sacrificial electric conductors 71 and 72 by energizing the dummy metal layer 60. The fourth sacrificial electric conductor 74 is thickened using plating through the first to the third sacrificial electric conductors 71 to 73 by energizing the dummy metal layer 60.

As depicted in FIG. 4M, an opening 34*a* is disposed in a portion of the fourth insulating resin 34 to dispose the fourth sacrificial electric conductor 74.

As depicted in FIG. 4N, the first to the fourth sacrificial electric conductors 71 to 74 are removed and the hole 35*a* corresponding to the inner flux path is disposed in the insulating resin body 35 including the spiral wirings 21 to 24 and the insulating resins 30 to 34. The first to the fourth sacrificial electric conductors 71 to 74 are removed by etching. The material of the sacrificial electric conductors 71 to 74 is, for example, the same material as that of the spiral wirings 21 to 24. In this manner, a coil substrate 5A is formed using the spiral wirings 21 to 24 and the insulating resins 30 to 34.

As depicted in FIG. 4O, the ends of the coil substrate 5A together with the ends of the mounting base 50 are cut out along the cutting lines 10. The cutting lines 10 are positioned to be spaced inwardly from the end faces of the dummy metal layer 60.

As depicted in FIG. 4P, the mounting base 50 is detached from the dummy metal layer 60 in the bonding face between the one face of the mounting base 50 (the base metal layer 52) and the dummy metal layer 60. As depicted in FIG. 4Q, the dummy metal layer 60 is removed from the coil substrate 5A.

As depicted in FIG. 4R, the coil substrate 5A is covered with the magnetic resin 40. The magnetic resin 40 fills the hole 35*a* of the insulating resin body 35 to configure the inner flux path and is also disposed on the outer surface of the insulating resin body 35 to configure the outer flux path. External terminals (not depicted) are connected to the ends of the spiral wirings 21 to 24 to form a coil component 2A.

Figure 5:
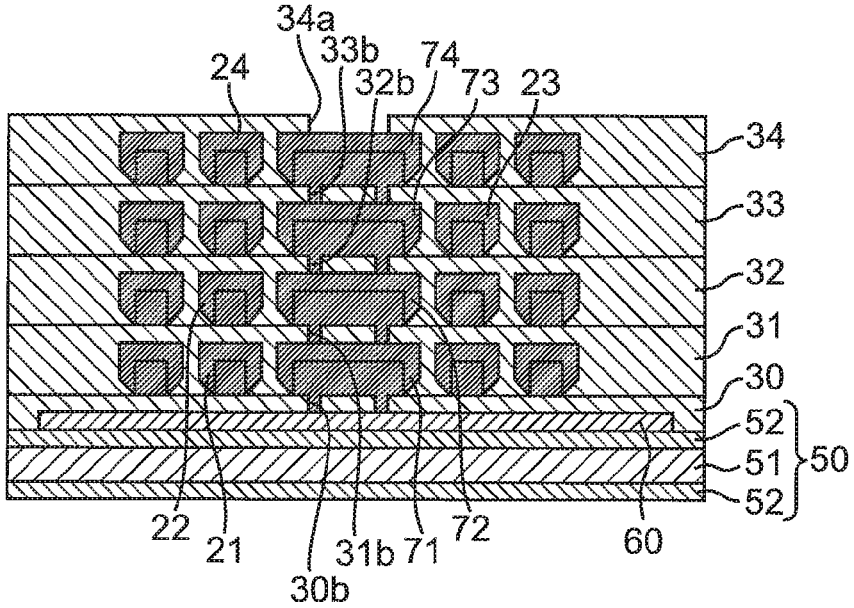
FIG. 5 is a diagram for explaining another embodiment of the manufacture method of a coil component of the present disclosure.

As depicted in FIG. 4M, the opening 30*a* of the base insulating resin 30, the opening 31*a* of the first insulating resin 31, the opening 32*a* of the second insulating resin 32, and an opening 33*a* of the third insulating resin 33 are all fully open while, as depicted in FIG. 5, an opening 30*b* of the base insulating resin 30, an opening 31*b* of the first insulating resin 31, an opening 32*b* of the second insulating resin 32, and an opening 33*b* of the third insulating resin 33 may each be open in an annular shape. The load of processing the openings using laser processing or the like can thereby be reduced. Because the insulating resin remains in the center of each of the openings, the amount of used material of the sacrificial electric conductors can be reduced.

According to the manufacture method of the coil component 2A, the first spiral wiring 21 and the first sacrificial electric conductor 71 are disposed at one step. The first spiral wiring 21 and the first sacrificial electric conductor 71 are both electric conductors, and can therefore be formed at the one step. The same is applied to the case where the second to the fourth spiral wirings 22 to 24 and the second to the fourth sacrificial electric conductors 72 to 74 are disposed. The total is thereby less than the tolerance of the position of the hole 35*a* (the sacrificial electric conductors 71 to 74) for the inner flux path relative to the insulating resins 30 to 34 and the tolerance of the positions of the spiral wirings 21 to 24 relative to the insulating resins 30 to 34. As a result, the cross-sectional area of the inner flux path can be set to be large and a higher inductance value can be acquired.

In contrast, when the step of forming the hole for the inner flux path in the insulating resin and the step of forming the spiral wiring in the insulating resin are executed as separated steps, a degree of distance is necessary between the spiral wiring and the hole taking into consideration the total of the tolerance of the position of the hole relative to the insulating resin and the tolerance of the position of the spiral wiring relative to the insulating resin. The cross-sectional area of the hole is thereby reduced by an area corresponding to the tolerance of the position of the hole and the tolerance of the position of the spiral wiring. As a result, the cross-sectional area of the inner flux path is reduced and acquisition of any high inductance value is difficult.

The first spiral wiring 21 is thickened using plating by directly or indirectly energizing the first spiral wiring 21 and the first sacrificial electric conductor 71 connected to the dummy metal layer 60 is thickened using plating by energizing the dummy metal layer 60. The difference can thereby be avoided between the thickness of the first spiral wiring 21 and the thickness of the first sacrificial electric conductor 71. The depth of the opening 31*a* is therefore small and the formation of the opening 31*a* is easy when the opening 31*a* is disposed in the portion of the first insulating resin 31 covering the first spiral wiring 21 and the first sacrificial electric conductor 71 to expose the first sacrificial electric conductor 71. The depth of the opening 32*a* is constant when the second spiral wiring 22 and the second sacrificial electric conductor 72 are disposed and the opening 32*a* is disposed in the second insulating resin 32. Even when the multiple layers are formed, the depths of the openings 31*a* to 34*a* are constant and the formation of the openings 31*a* to 34*a* is easy. The shapes of the sacrificial electric conductors 71 to 74 disposed in the openings 31*a* to 34*a* can be set to be the same.

Figure 6A:
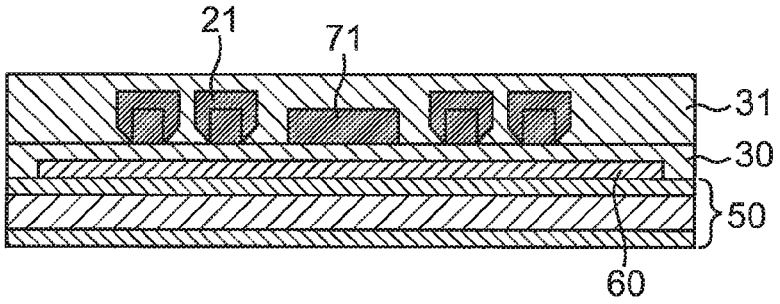
FIG. 6A is a diagram for explaining a comparative example of the manufacture method of a coil component.
Figure 6B:
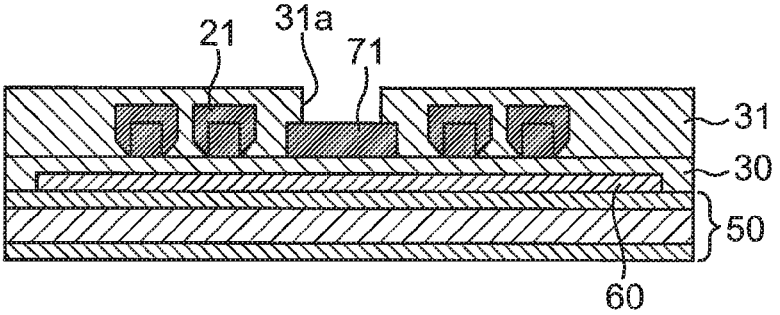
FIG. 6B is a diagram for explaining the comparative example of the manufacture method of a coil component.
Figure 6C:
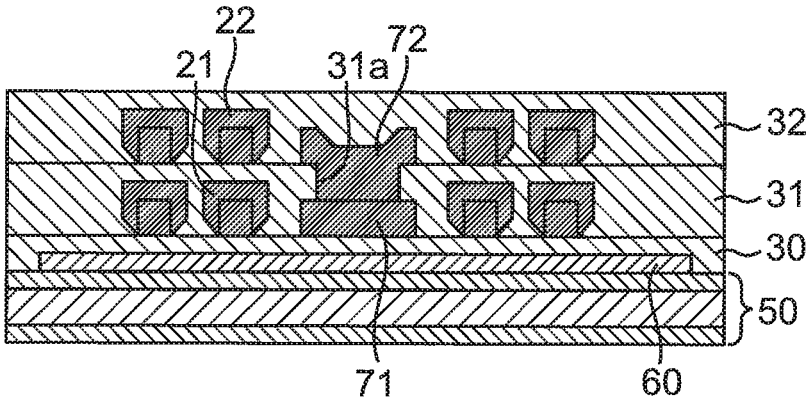
FIG. 6C is a diagram for explaining the comparative example of the manufacture method of a coil component.
Figure 6D:
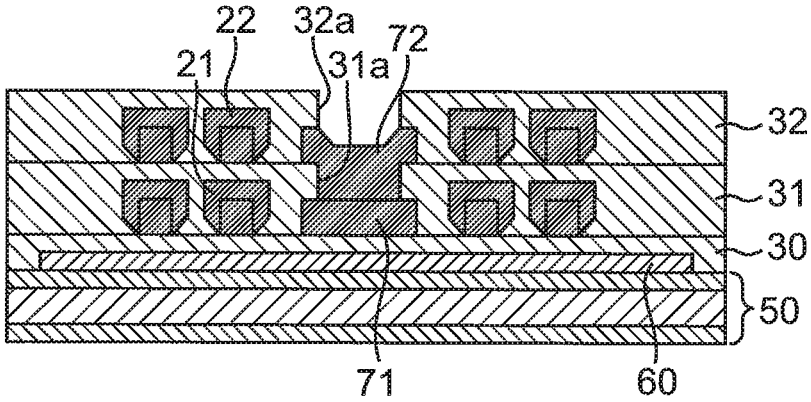
FIG. 6D is a diagram for explaining the comparative example of the manufacture method of a coil component.
Figure 6E:
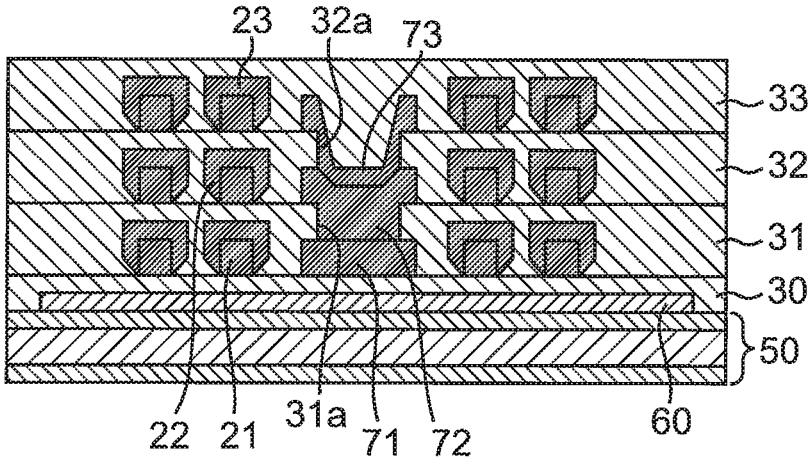
FIG. 6E is a diagram for explaining the comparative example of the manufacture method of a coil component.
Figure 6F:
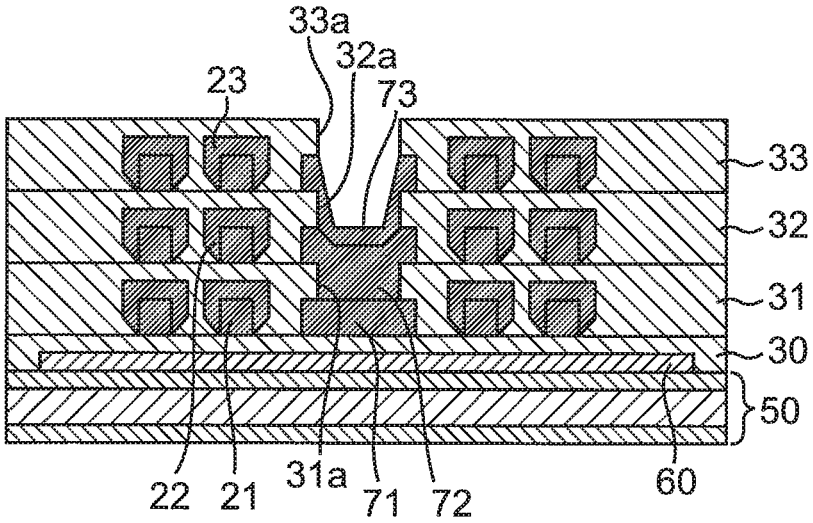
FIG. 6F is a diagram for explaining the comparative example of the manufacture method of the coil component.
Figure 6G:
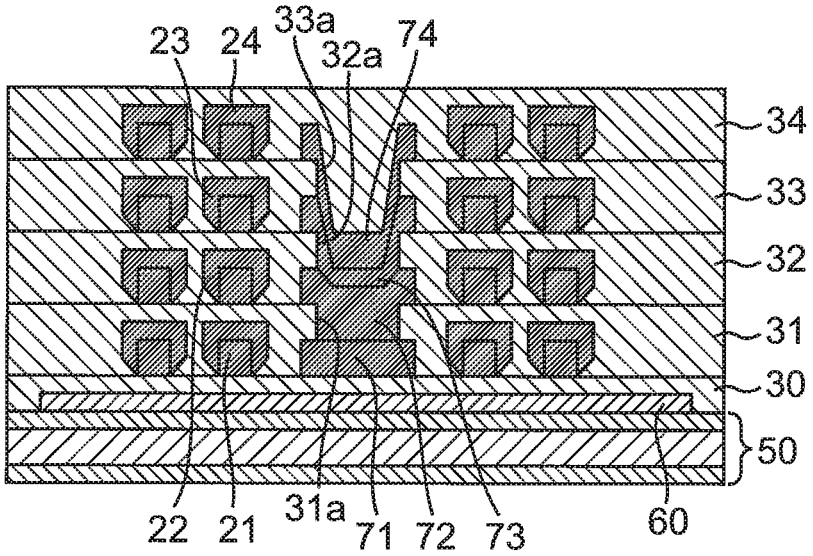
FIG. 6G is a diagram for explaining the comparative example of the manufacture method of a coil component.
Figure 6H:
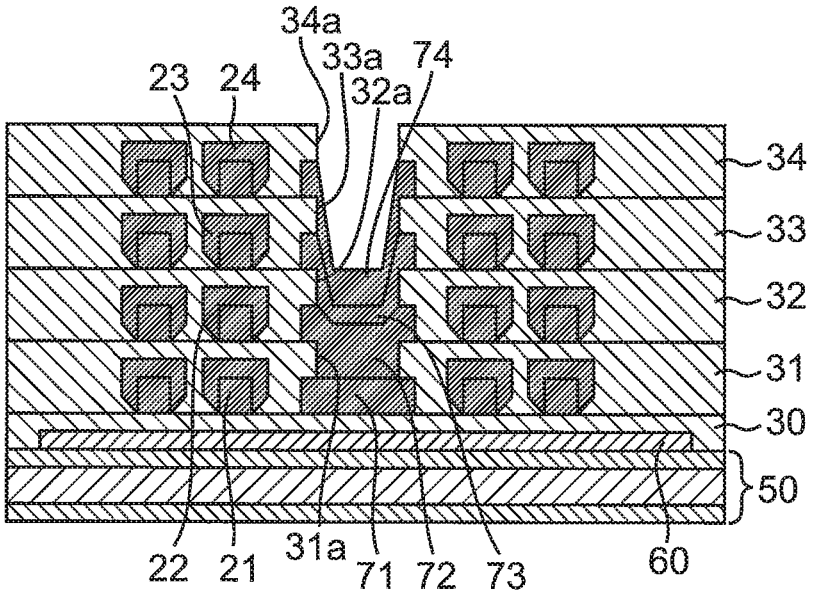
FIG. 6H is a diagram for explaining the comparative example of the manufacture method of a coil component.

In contrast, as depicted in FIG. 6A, when the first spiral wiring 21 is thickened using plating while the first sacrificial electric conductor 71 is not thickened using plating, a difference is generated between the thickness of the first spiral wiring 21 and the thickness of the first sacrificial electric conductor 71. As depicted in FIG. 6B, the depth of the opening 31*a* is large when the opening 31*a* is disposed in the portion of the first insulating resin 31 covering the first spiral wiring 21 and the first sacrificial electric conductor 71 to expose the first sacrificial electric conductor 71. Especially, when, as depicted in FIG. 6C, the second spiral wiring 22 and the second sacrificial electric conductor 72 are disposed and, as depicted in FIG. 6D, the opening 32*a* is disposed in the second insulating resin 32, the depth of the opening 32*a* becomes larger. As depicted in FIG. 6E to FIG. 6H, the depths of the openings 33*a* and 34*a* become larger and the formation of the openings 33*a* and 34*a* becomes more difficult as the layers are increased. The focus of the laser beam needs to be shifted for each of the layers when the openings 31*a* to 34*a* are formed using laser processing because the openings 31*a* to 34*a* of the layers become gradually deeper. It is also difficult to dispose the sacrificial electric conductors 71 to 74 in the openings 31*a* to 34*a*.

The present disclosure is not limited to the disclosed embodiments, and changes can be made to the design thereof within the scope not departing from the gist of the present disclosure. For example, the features of the first embodiment and those of the second embodiment may variously be combined with each other.

In the embodiments, the coil component includes the spiral wirings in the four layers and the insulating resins in the five layers while the coil component only has to include at least the spiral wirings in the two layers (the first and the second spiral wirings) and at least the insulating resins in the three layers (the base insulating resin, and the first and the second insulating resins).

In the embodiments, the mounting base is set to include the insulating substrate and the base metal layer while the mounting base may include only the insulating substrate omitting the base metal layer.

In the embodiments, the coil substrate is formed on the one face of both faces of the mounting base while the coil substrate may be formed on each of both faces of the mounting base. High productivity can thereby be acquired.

The invention claimed is:

1. A manufacture method of a coil component, comprising the steps of:

bonding a dummy metal layer onto a mounting base;

stacking a base insulating resin on the dummy metal layer;

stacking a first spiral wiring and a first insulating resin in this order on the base insulating resin to cover the first spiral wiring with the first insulating resin and stacking a second spiral wiring and a second insulating resin in this order on the first insulating resin to cover the second spiral wiring with the second insulating resin, to form a coil substrate;

detaching the mounting base from the dummy metal layer at a bonding face between the mounting base and the dummy metal layer;

removing the dummy metal layer from the coil substrate; and covering the coil substrate with a magnetic resin.

2. The manufacture method of a coil component according to claim 1, wherein the mounting base includes an insulating substrate and a base metal layer disposed on the insulating substrate and bonded to the dummy metal layer.

3. The manufacture method of a coil component according to claim 1, wherein the step of forming the coil substrate includes the steps of:

disposing an opening in the base insulating resin to expose the dummy metal layer;

disposing the first spiral wiring on the base insulating resin and disposing a first sacrificial electric conductor that corresponds to an inner flux path, on the dummy metal layer in the opening of the base insulating resin;

thickening the first spiral wiring using plating by directly or indirectly energizing the first spiral wiring and thickening the first sacrificial electric conductor connected to the dummy metal layer using plating by energizing the dummy metal layer;

covering the first spiral wiring and the first sacrificial electric conductor with the first insulating resin;

disposing an opening in the first insulating resin to expose the first sacrificial electric conductor;

disposing the second spiral wiring on the first insulating resin and disposing a second sacrificial electric conductor that corresponds to an inner flux path, on the first sacrificial electric conductor in the opening of the first insulating resin;

thickening the second spiral wiring using plating by directly or indirectly energizing the second spiral wiring and thickening the second sacrificial electric conductor using plating through the first sacrificial electric conductor by energizing the dummy metal layer;

covering the second spiral wiring and the second sacrificial electric conductor with the second insulating resin;

disposing an opening in the second insulating resin to expose the second sacrificial electric conductor; and removing the first sacrificial electric conductor and the second sacrificial electric conductor to form a hole that corresponds to an inner flux path, wherein at the step of covering the coil substrate with the magnetic resin, the hole is filled with the magnetic resin to configure the inner flux path using the magnetic resin.

* * * * *